United States Patent [19]

Borsini

[11] 3,950,798

[45] Apr. 20, 1976

[54] EASILY WASHABLE AND RECONSTRUCTABLE MATTRESS

[76] Inventor: Latino Borsini, viale Campania 5, Milan, Italy, 20133

[22] Filed: Aug. 26, 1974

[21] Appl. No.: 500,827

[30] Foreign Application Priority Data

Nov. 18, 1971 Italy ..... 31258/71

Related U.S. Application Data

[63] Continuation of Ser. No. 302,436, Oct. 31, 1972, abandoned.

[52] U.S. Cl. ..... 5/337

[51] Int. Cl.[2] ..... A47G 9/00

[58] Field of Search ..... 5/337, 351, 355, 361, 5/352, 357

[56] References Cited

UNITED STATES PATENTS

| | | | |
|---|---|---|---|
| 1,271,672 | 7/1918 | Growley | 5/353 |
| 1,579,074 | 3/1936 | Burton | 5/357 X |
| 1,822,948 | 9/1931 | Armstrong | 5/339 |
| 2,154,910 | 4/1939 | Magaril | 5/357 |

*Primary Examiner*—Paul R. Gilliam
*Assistant Examiner*—Doris L. Troutman
*Attorney, Agent, or Firm*—Guido Modiano; Albert Josif

[57] ABSTRACT

An easily washable and reconstructable hygienic mattress in which its enclosure consists of a perimetral box-like band and two equal half-linings, namely a bottom and a top, joinable by their edge to the band by connection means the stuffing being provided in prefabricated elements removably inserted into said enclosure.

1 Claim, 7 Drawing Figures

EASILY WASHABLE AND RECONSTRUCTABLE MATTRESS

This is a continuation, of application Ser. No. 302,436 filed Oct. 31, 1972 and now abandoned.

BACKGROUND OF THE INVENTION

The present invention relates to an easily washable and reconstructable hygienic mattress, and a process for making the same.

Before passing to summarise the main defects of mattresses now in use which the present invention is designed to eliminate, let us briefly examine the schematic structure of a mattress and its working conditions.

A mattress is a complex supporting structure, of elastic and plastic deformability, subjected to both static and dynamic stresses. It must be elastic in order to allow a determined percentage sinking of the load, while leaving the axis of the load, i.e. of the human body lying down, unaltered. The mattress also has further functions such as that of allowing the transpiration of the supported body, and it must above all be a suitable thermal insulator.

These functions and requirements have made the woollen mattress the practical solution which is even today by far the most convenient. It was able to constitute an almost ideal solution, however, only when a large availability of artisan labour enabled it to be frequently washed and reconstructed at low cost. Recently therefore new types of spring, rubber and expanded synthetic resin mattresses have been designed and placed on the market.

Spring mattresses represent conceptually a classical combination of the woollen mattress and the old "elastic" mattress, today replaced by metal wire mesh mattresses. In this type of mattress the insulating layer which also distributes the load on to the springs consists of fragments of cloth or rags pressed together. The mechanical life of the mattress has thus been prolonged. However the cleaning and hygiene aspects have been worsened, as these mattresses are even less easy to wash than woollen mattresses.

Rubber and synthetic resin mattresses also constitute a mechanically valid solution, and can be more easily washed, but they lack a thermally insulating layer, and give a sensation of cold in winter and tackiness in summer, and can also be the cause of discomfort.

Furthermore the rubber and resins can give off small quantities of toxic gases due to the heat imparted by the person lying down, and this can be a source of disturbance to the user.

The deminished frequency with which woollen mattresses are washed and the introduction of new mattresses have made more acute or given rise to a further danger for hygiene, which is, under different aspects, common to all the types of stated mattresses in use. The supporting structure of the mattress is subjected to fatigue and wear stresses because of the surface friction between fibres and the friction inside the material. This leads in time to a reduction to very fine dust both of the structural material and of the dirt which has penetrated into the mattress. The applicant has found that from a minimum of 1% to 12% or more by weight of the organic substances comprising the mattress are effectively reduced to powder in the first ten years of use. A part of this powder can finish in the lungs by respiration.

A further disadvantage is that the inside of the mattress cannot be inspected either at purchase or after use.

SUMMARY OF THE INVENTION

The general object of the present invention is to substantially eliminate all the listed defects by providing a mattress of new conception.

A particular object of the invention is to provide a mattress in which, in case of necessity, a single part of the lining can be instantly replaced by a spare part without difficulty. A further object is that of the possibility in the mattress according to the invention of replacing a part or parts of the stuffing by spare parts, as easily as removing or replacing an object in a drawer.

A further object of the invention is to provide a mattress of economical construction.

According to a further aspect of the invention a further object is to describe an easy and economical process for the industrial production of a mattress according to the invention.

These and further objects which will be more evident hereinafter are attained by a hygienic reconstructable mattress according to the present invention in which its enclosure consists of a perimetral box-like band and two equal half-linings, namely a top and a bottom, joinable at their edge to the band by connection means, the stuffing being provided in prefabricated elements removably inserted into said enclosure.

According to a further aspect of the invention the stuffing elements for said mattress are manufactured by a method in which a tubular container is mounted on a sleeve from which the stuffing material is thrust extruded, said container being stretched along the material similar to a stocking and being dragged by it, and then being tied or sewn at the ends.

BRIEF DESCRIPTION OF THE DRAWINGS

The characteristics and advantages of the invention will be more evident from the description of its preferred but not exclusive embodiments, given by way of example with reference to the accompanying drawings in which.

DESCRIPTION OF THE PREFERRED EMBODIMENTS

The figures show the structure 1 forming the insulating stuffing, in the form of a number of compoundable elements according to the invention, and a single element 2. It can be seen that the elements are disposed transversely to the length of the mattress, of which they occupy the entire width. They are of square cross-section and their container consists of a tubular mesh 3 of square cross-section, closed at both ends, into which is pressed mattress wool 4.

Figure 1:
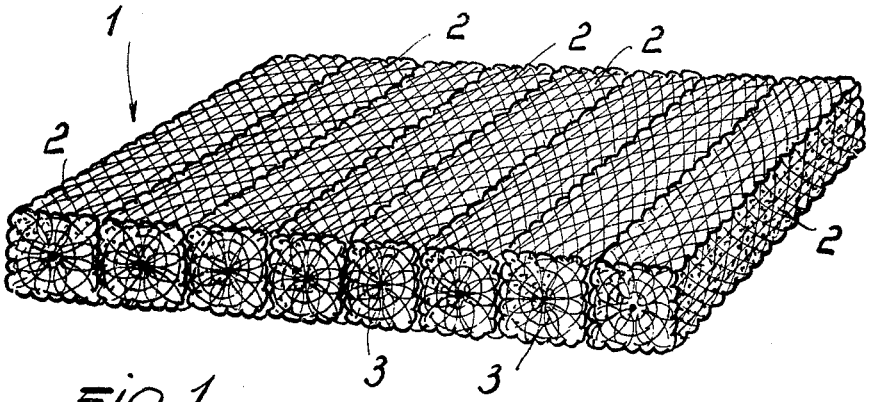
FIG. 1 is a perspective view showing how the structure of a mattress according to the invention is made up.
Figure 2:
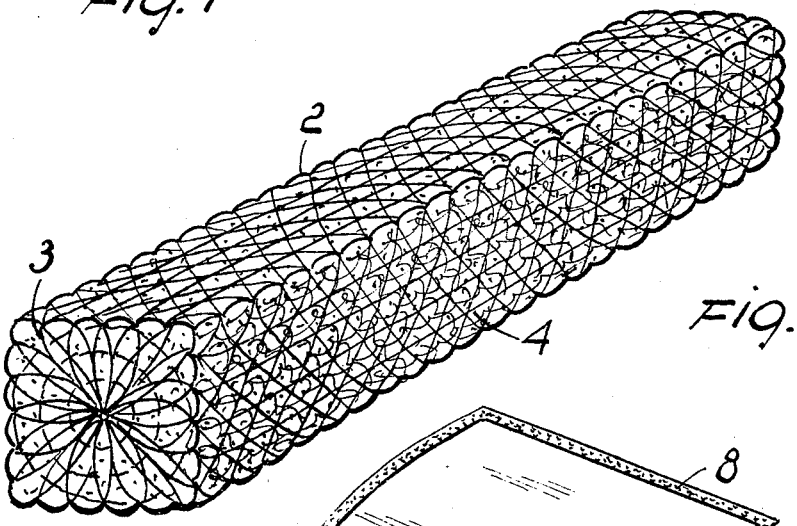
FIG. 2 is a perspective view of a single prefabricated element according to the invention.
Figure 3:
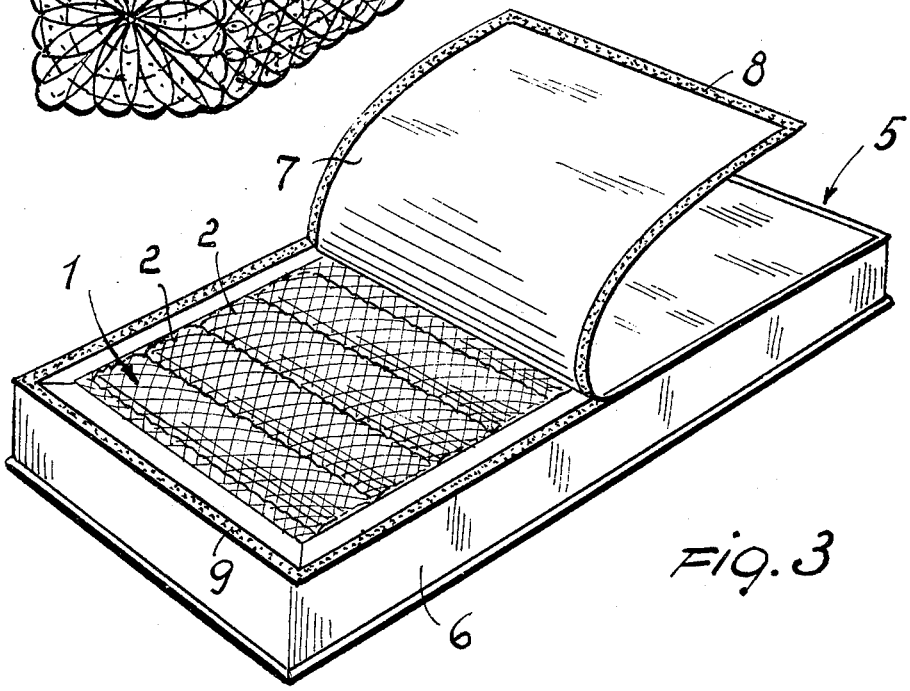
FIG. 3 is a perspective diagrammatic view of a mattress assembled with the upper half-lining partially raised.
Figure 4:
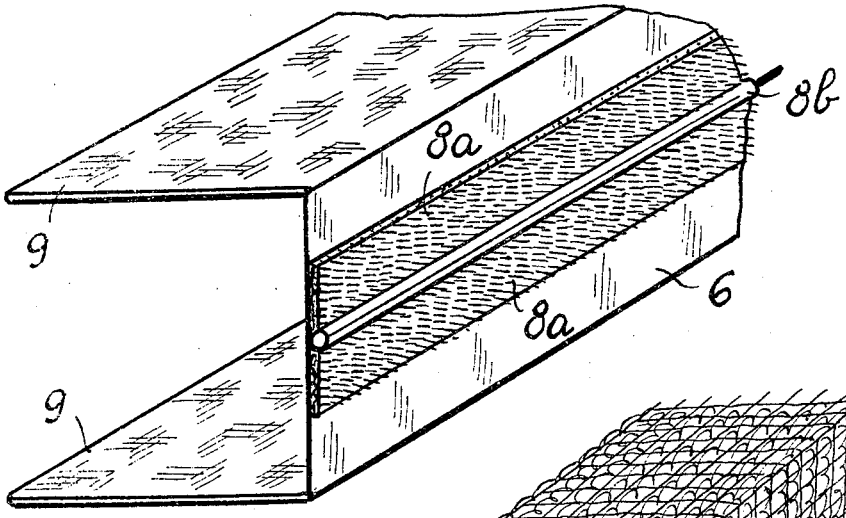
FIG. 4 is a perspective view of a detail of a modification of the lateral band of the lining.

FIG. 3 shows in particular how the elements are arranged, they being simply placed side by side under slight pressure within a lining or tick 5 consisting of a closed band or peripheral flap 6 on which is rested a half-lining 7 as a top cover, similar to an opposing bottom cover portion or half-lining (this in effect becomes the top cover by turning the mattress) not shown in the figure, said half-lining being fixed by adhesive friction tape or other openable jointing means to the edge 9 of the band 6. In a modification shown in FIG. 4, the half-linings instead of being fixed to the edge 9 of the band are folded over the edge and are joined at their edge 8 by adhesive tapes 8a respectively placed about the centre of the band 6, with the advantage of a more efficient wrapping and a stronger hold, because of the presence of the corner. A cord 8b serves as a strengthening rib.

Figure 5:
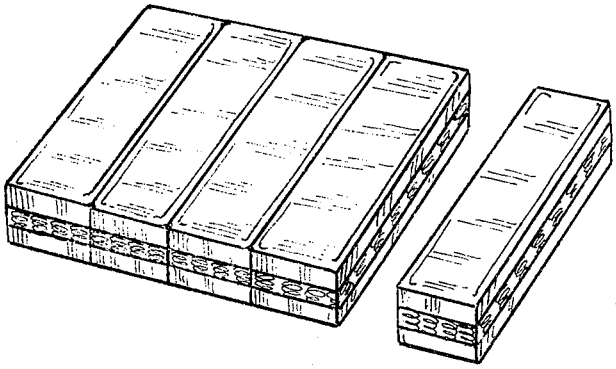
FIG. 5 is a diagrammatic perspective view showing the configuration of a mattress stuffing according to a modification of the invention.

FIG. 5 shows diagrammatic a modified embodiment of the invention in which the mattress stuffing is composed of prefabricated elements, according to the invention, each element being performed substantially as a spring-mattress, or spring-cushion, with the advantage, compared with common spring-mattress, that each element is easily washable and replaceable, and each element may have different springing hardness, according to the relative position and the supported load.

Figure 6:
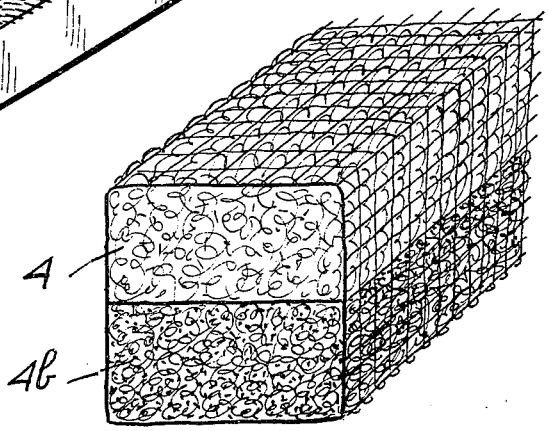
FIG. 6 is a perspective view of a finished element obtained with two different simultaneous fillings, according to a further modification of the invention.

FIG. 6 shows an element produced from a two compartment container, in which one compartment is filled with wool 4 and the other with horsehair 4b, so as to provide a mattress with a warm face of wool, and a less warm face of horsehair for the summer.

Figure 7:
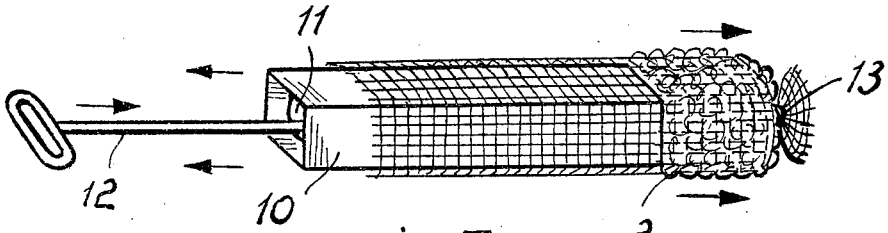
FIG. 7 is a diagrammatic illustration of a process for prefabricating mattress elements according to the invention.

FIG. 7 shows diagrammtically the constructional principle of a structure element of a mattress according to the invention. It shows a sleeve 10 of square cross-section, for example of metal or plastic, and a piston 11 which slides tightly in said sleeve, the rod of said piston being indicated by the reference numeral 12. Into the sleeve 10 is loaded a batch of wool or horsehair, and over the sleeve is mounted the mesh of a container 3, closed at one end by a binding 13. As it is thrust by the piston 10 the wool is extruded from the end in the direction of advancement of the piston and fills the mesh which contains it and is dragged along. FIG. 7 shows a part of an element 2 already formed. At the end of the stroke there remains only to tie the mesh at the other end.

The process is described in the Figure as operable by hand, but it is evident to experts in the art that it can be carried out by a machine made completely automatic by known means, on the same working principle.

In the limit the container may be reduced to a single thread which wraps a bale of wool, for example in the manner that a salami is wrapped or a bale of straw is tied.

It can be seen that all the proposed objects are attained. The advantages comprise the great simplicity of the design, because of which the cost of manufacture of a mattress according to the invention constructed on a series production basis will be less than that of a classical woollen mattress of equal weight, together with the decisive advantages of hygiene and long life.

Further advantages can be seen. By filling elements of equal volumes with a greater or lesser quantity of wool or horsehair, elements of equal volume can be obtained which are suitable for different body weights, so providing for example a light type, a medium and a heavy type. Heavier elements can be arranged where the mattress is more loaded, such as at the centre, and lighter elements elsewhere. Longer mattresses can be made for abnormal lengths by providing longer linings and adding more elements.

As the wool is made better contained than in the quilted mattress its life will be greatly increased, before the element loses height; moreover the more loaded elements can be changed in position by rotating them amongst themselves. Alternatively the individual deformed elements can be rotated through 90° about their longitudinal axis, so obtaining a dimensional recovery in the shortened direction.

The advantages listed are equally a perogative of the invention.

The invention is susceptible to numerous modifications all of which fall within the scope of the inventive idea, which is clearly defined by the objects, description, examples and the following claims.

I claim:

1. Washable reconstructable mattress, comprising a flexible tick of substantially parallelpiped shape when filled and having a lengthwise extension, a widthwise extension and a thickness extension, the tick having further a top and a bottom cover portion with peripheral edges and a peripheral flap portion extending over the sides of the tick and detachably connecting said peripheral edges of the top and bottom cover portions to allow at least one of said top and cover portions to be opened for insertion therein and extraction therefrom of stuffing elements, inserted within said tick juxtaposed independent prismatic stuffing elements of square cross-section and having its longitudinal extension extending over the entire widthwise extension of the tick and having the length of a side of said square cross-section corresponding to said thickness extension of the tick, each of said stuffing elements comprising a reticulate enclosure surrounding a prismatic space corresponding to the shape of said prismatic stuffing elements and within said reticulate enclosure a first stuffing material of selected thermal properties filling a portion of said space surrounded by said reticulate enclosure, said space portion extending over the entire longitudinal extension of the prismatic stuffing element, and leaving free the remaining superposed portion of said space likewise extending over the entire longitudinal extension of the prismatic stuffing elements and within said remaining space portion a second stuffing material of different thermal properties as compared to said first stuffing material, thereby to obtain a stuffing element having two layers of different stuffing material and allowing the stuffing elements to be selectively rotated at least once through 90° with respect to each other in order to expose towards the top cover portion of the tick selectively the desired stuffing material of each stuffing element.

* * * * *